US009189978B2

(12) United States Patent
Tataryan et al.

(10) Patent No.: US 9,189,978 B2
(45) Date of Patent: Nov. 17, 2015

(54) LABELS, LABEL SHEET ASSEMBLIES, AND RELATED METHODS

(71) Applicant: Avery Dennison Corporation, Pasadena, CA (US)

(72) Inventors: Anahit Tataryan, Arcadia, CA (US); Joshua David Petrie, Brea, CA (US); Jay Kiyoshi Sato, Mission Viejo, CA (US); Thomas Mammen, La Verne, CA (US)

(73) Assignee: CCL Label, Inc., Framingham, MA (US)

( * ) Notice: Subject to any disclaimer, the term of this patent is extended or adjusted under 35 U.S.C. 154(b) by 111 days.

(21) Appl. No.: 13/778,124

(22) Filed: Feb. 27, 2013

(65) Prior Publication Data

US 2014/0242319 A1 Aug. 28, 2014

(51) Int. Cl.

| | |
|---|---|
| ***G09F 3/02*** | (2006.01) |
| ***B26D 3/08*** | (2006.01) |
| ***G09F 3/10*** | (2006.01) |
| ***B26F 1/20*** | (2006.01) |
| ***B26F 1/22*** | (2006.01) |
| ***B26F 1/44*** | (2006.01) |

(52) U.S. Cl.

CPC .. *G09F 3/02* (2013.01); *B26D 3/08* (2013.01); *B26F 1/20* (2013.01); *B26F 1/22* (2013.01); *B26F 1/44* (2013.01); *G09F 3/10* (2013.01); *G09F 2003/0201* (2013.01); *G09F 2003/0222* (2013.01); *G09F 2003/0226* (2013.01); *G09F 2003/0267* (2013.01); *G09F 2003/0269* (2013.01); *Y10T 83/0341* (2015.04); *Y10T 428/14* (2015.01); *Y10T 428/149* (2015.01); *Y10T 428/1476* (2015.01)

(58) Field of Classification Search

CPC ..... G09F 3/02; G09F 3/10; G09F 2003/0267; G09F 2003/0201; G09F 2003/0269; G09F 2003/0222; B26F 1/44; B26F 1/20; B26F 1/22; B26D 3/08; Y10T 428/1476; Y10T 428/14; Y10T 428/1486; Y10T 428/149; Y10T 428/1495; Y10T 428/15

See application file for complete search history.

(56) References Cited

U.S. PATENT DOCUMENTS 4,317,852 A * 3/1982 Ogden ..... 428/40.1
4,478,666 A * 10/1984 Ogden ..... 156/240

(Continued)

FOREIGN PATENT DOCUMENTS

WO WO03/020597 3/2003

OTHER PUBLICATIONS

International Search Report and the Written Opinion of the International Searching Authority, PCT/US14/18869, CCL Label, Inc., May 30, 2014.

*Primary Examiner* — Patricia L Nordmeyer
(74) *Attorney, Agent, or Firm* — McDonald Hopkins LLC

(57) ABSTRACT

The present invention relates to self-adhesive labels, label sheet assemblies, and related methods. The label sheet assembly includes a release liner assembly having a detachable portion, and a label releasably coupled to the release liner assembly and overlying the detachable portion. Weakened separation lines, a U-shaped cut, and a transverse cut define the detachable portion. The detachable portion is configured to remain coupled to the label as the label is peeled from the release liner assembly in a first direction, and the detachable portion is configured to remain part of the release liner assembly and separate from the label as the label is peeled from the release liner assembly in a second direction.

19 Claims, 14 Drawing Sheets

(56) References Cited

U.S. PATENT DOCUMENTS

| | | | | |
|---|---|---|---|---|
| 4,584,219 | A * | 4/1986 | Baartmans | 428/42.3 |
| 4,599,125 | A | 7/1986 | Buck | |
| 5,484,168 | A * | 1/1996 | Chigot | 283/67 |
| 5,842,722 | A | 12/1998 | Carlson | |
| 6,177,163 | B1 * | 1/2001 | Blok et al. | 428/40.1 |
| 6,581,973 | B2 * | 6/2003 | Levine et al. | 283/81 |
| 6,803,084 | B1 * | 10/2004 | Do et al. | 428/40.1 |
| 7,641,951 | B2 | 1/2010 | Hodsdon et al. | |
| 7,709,071 | B2 | 5/2010 | Wong et al. | |
| 8,507,065 | B2 * | 8/2013 | Milson | 428/40.1 |
| 2005/0089663 | A1 * | 4/2005 | Wong et al. | 428/42.3 |
| 2005/0238836 | A1 | 10/2005 | Hodsdon | |
| 2006/0257607 | A1 * | 11/2006 | Crooks et al. | 428/40.1 |
| 2010/0109316 | A1 * | 5/2010 | Hong et al. | 283/81 |
| 2010/0233411 | A1 * | 9/2010 | Flynn et al. | 428/43 |
| 2012/0315422 | A1 * | 12/2012 | Cushing et al. | 428/41.8 |

* cited by examiner 117
111
110
131
112
122
14
4
104b
115
40
106
104a
110
110
110
110
141
117
134
115
106
104a
112

111
150
134
112
104b
114

114
115
134
104a
111
143
10
110
112
142
24
34
117
106
144

LABELS, LABEL SHEET ASSEMBLIES, AND RELATED METHODS

TECHNICAL FIELD

The present invention relates generally to the art of self-adhesive labels and label sheet assemblies, and more particularly to printable self-adhesive labels, label sheet assemblies, and related methods.

BACKGROUND

Printable self-adhesive labels and label sheets having multiple self-adhesive labels are generally known. Label consumers and users often attach these self-adhesive labels around objects with non-planar surfaces, such as around cylindrical objects and the like. The standard method for attaching self-adhesive labels around non-planar surfaces is that a user bends back the label sheet somewhere in the vicinity of one of the edges or corners of the label to be removed. This causes a separation between the label and the liner of the label sheet. The user then grasps the label in the area where the separation has been created, and fully removes the label from the sheet and liner. With the entire adhesive backing exposed, the user then attaches a first portion of the label onto a first section of the non-planar surface and then continues to apply the label to the surface until the entire label is adhered to the surface. However, in some cases, especially where the label is flexible or conformable, it becomes difficult to attach a label around a non-planar surface using the standard method while maintaining a smooth label surface. Application of a label to a non-smooth surface can often make it difficult for any indicia printed or otherwise written on the surface of the label to be clearly or easily visible.

SUMMARY

The present invention relates generally to the art of self-adhesive labels and label sheet assemblies, and more particularly to printable self-adhesive labels, label sheet assemblies, and related methods.

In one embodiment, the label sheet assembly includes a release liner assembly having a detachable portion, and a label releasably coupled to the release liner assembly and overlying the detachable portion. Weakened separation lines, a U-shaped cut, and a transverse cut define the detachable portion. The detachable portion is configured to remain coupled to the label as the label is peeled from the release liner assembly in a first direction, and the detachable portion is configured to remain part of the release liner assembly and separate from the label as the label is peeled from the release liner assembly in a second direction.

In other more detailed features, the label sheet assembly includes a facestock sheet assembly that includes the label releasably coupled to the release liner assembly, and cuts in the facestock sheet assembly defining the shape of the label, such as rectangular.

In more detailed features, the weakened separation lines are cuts and ties, perforated cuts, or micro-perforated cuts. In other more detailed features, the weakened separation lines in the release liner assembly underlie a portion of the cuts in the facestock sheet assembly. In other more detailed features, the weakened separation lines in the release liner assembly underlie the label. In other more detailed features, the U-shaped cut includes tine-cuts, which are co-linear with the weakened separation lines. In other more detailed features, the U-shaped cut includes tine-cuts, which are offset from the weakened separation lines.

In one embodiment, a method of manufacturing label sheet assemblies includes providing a roll of label stock having a facestock sheet assembly releasably adhered to a release liner assembly, forming cuts in the facestock sheet assembly, and forming weakened separation lines, a U-shaped cut, and a transverse cut in the release liner assembly. The cuts in the facestock sheet assembly define a label. The weakened separation lines, the U-shaped cut, and the transverse cut define a detachable portion of the release liner assembly. The detachable portion is configured to remain coupled to the label as the label is peeled from the release liner assembly in a first direction, and the detachable portion is configured to remain part of the release liner assembly and separate from the label as the label is peeled from the release liner assembly in a second direction.

In other more detailed tasks, the method includes sheeting the roll of label stock into individual label sheet assemblies. In other more detailed tasks, the tasks of forming the cuts in the facestock sheet assembly and forming the weakened separation lines in the release liner assembly are performed using a bi-level die. In other more detailed tasks, the task of forming the U-shaped cut and the weakened separation lines in the release liner assembly is performed using a single-level die.

In other more detailed features, during the task of forming the weakened separation lines in the release liner assembly, the weakened separation lines are formed under a portion of the cuts in the facestock sheet assembly. In other more detailed features, during the task of forming the weakened separation lines in the release liner assembly, the weakened separation lines are formed offset from the cuts in the facestock sheet assembly. In other more detailed features, during the task of forming the weakened separation lines in the release liner assembly, the weakened separation lines are formed under the label. In other more detailed features, the U-shaped cut includes tine-cuts, and the tine-cuts are co-linear with the weakened separation lines. In other more detailed features, the U-shaped cut includes tine-cuts, and the tine-cuts are offset from the weakened separation lines. In other more detailed features, the U-shaped cut includes tine-cuts, and the tasks of forming the cuts in the facestock sheet assembly and forming the weakened separation lines in the release liner assembly further include forming the tine-cuts using a bi-level die. In other more detailed embodiments, the tasks of forming the cuts in the facestock sheet assembly and forming the weakened separation lines in the release liner assembly include die cutting, etching, or laser cutting.

This summary is provided to introduce a selection of concepts that are further described below in the detailed description. This summary is not intended to identify key or essential features of the claimed subject matter, nor is it intended to be used in limiting the scope of the claimed subject matter. Numerous advantages and benefits of the inventive subject matter disclosed herein will become apparent to those of ordinary skill in the art upon reading and understanding the present specification.

BRIEF DESCRIPTION OF THE DRAWINGS

The inventive subject matter disclosed herein can take form in various components and arrangements of components, and in various steps and arrangements of steps. The drawings are only for purposes of illustrating exemplary embodiments and are not to be construed as limiting. Further, it is to be appreciated that the drawings may not be to scale.

Embodiments of a label, label sheet assembly, and related methods thereof, according to the present invention are described with reference to the following figures. The same reference numerals are used throughout the figures to reference like features and components.

DETAILED DESCRIPTION

Figure 1:
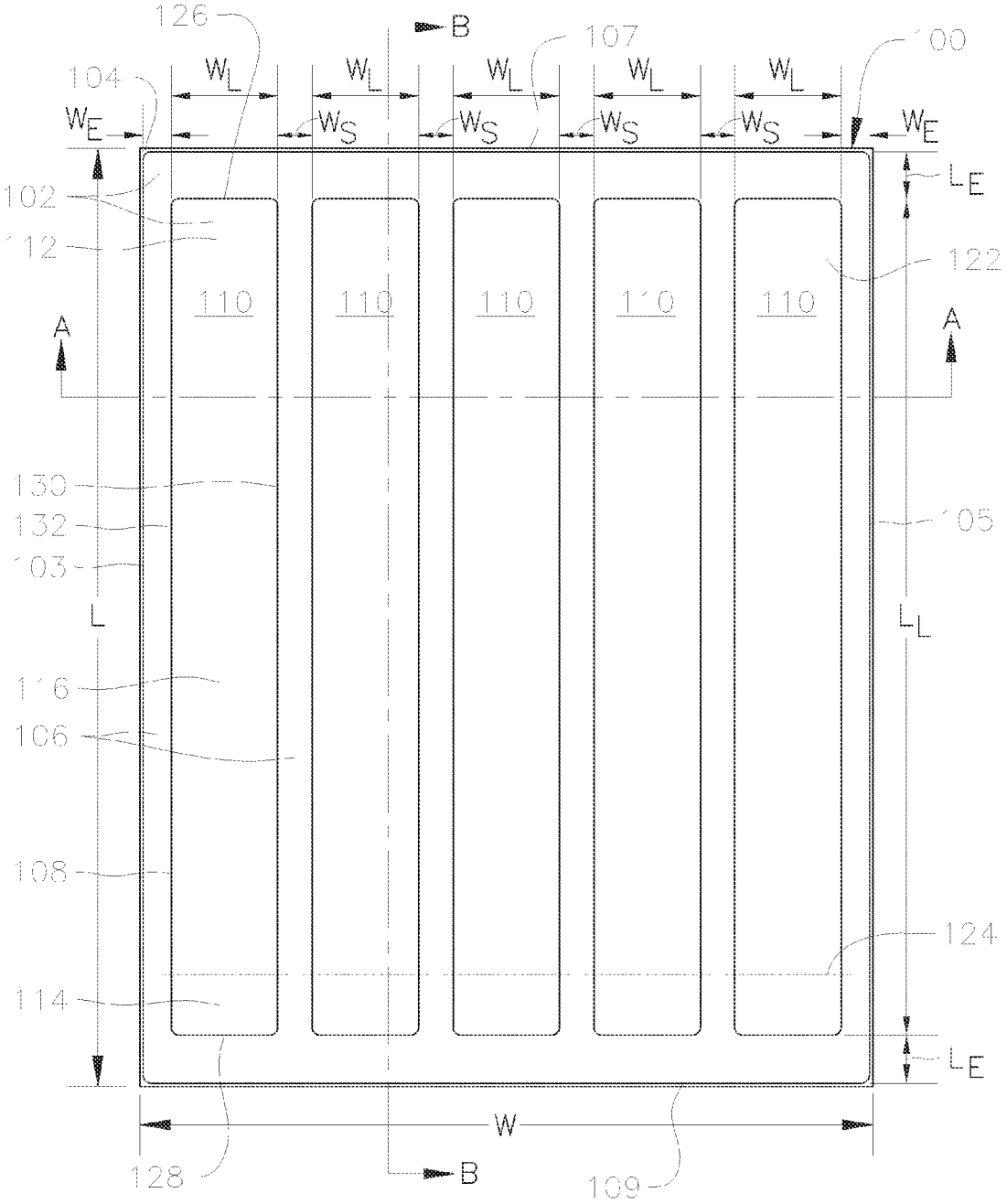
FIG. 1 is a top plan view of a label sheet assembly having a plurality of labels each having a first end, a second end, and a middle portion according to one embodiment of the present invention.

For clarity and simplicity, the present specification shall refer to structural and/or functional elements, relevant standards and/or protocols, and other components that are commonly known in the art without further detailed explanation as to their configuration or operation except to the extent they have been modified or altered in accordance with and/or to accommodate the preferred embodiment(s) presented herein.

The present invention relates generally to the art of self-adhesive labels and label sheet assemblies, and more particularly to printable self-adhesive labels, label sheet assemblies, and related methods. The labels of the label sheet assemblies of the present invention are configured to have a differential, bi-directional peel, such that when the labels are peeled or removed from the label sheet assembly in a first direction, the labels have a partially exposed adhesive surface, and when the labels are peeled or removed from a second direction, the labels have a fully exposed adhesive surface.

According to a first embodiment of the present invention illustrated in FIGS. 1 and 2, there is shown a label sheet assembly 100 (hereinafter "label sheet" or "label sheet assembly") having one label 110 or a plurality of labels 110 configured to have a differential, bi-directional peel, as described in more detail below. As used herein, the term plurality means two or more.

With reference now to FIGS. 1-4B, the label sheet assembly 100 includes a release liner assembly 104 having a front surface 104*a* and a rear surface 104*b* and a facestock sheet assembly 102 having a front surface 102*a* and a rear surface 102*b*. The rear surface 102*b* of the facestock sheet assembly 102 is releasably adhered to the front surface 104*a* of the release liner assembly 104 with a layer of adhesive 134 (hereinafter "adhesive," "layer of adhesive," or "adhesive layer") applied to the front surface 104*a* of the release liner assembly 104. The release liner assembly 104 includes a carrier 113 and the facestock sheet assembly 102 includes a facestock sheet 119. Optionally, the release liner assembly 104 can include a thin layer of release coating 136, such as silicone, coated on the carrier 113 such that the labels 110 can be easily removed therefrom. In an alternate embodiment shown in FIGS. 4*a* and 4*b*, the facestock sheet assembly 102 can optionally include a print receptive or indicia top coat layer 148 on the facestock sheet 119. The print receptive top coat layer 148 can be employed to enhance the ability of the label 110 to receive and/or retain markings, e.g., from ink, toner, highlighters, pens, pencils, etc. Additionally, the label sheet assembly 100 can include a primer layer 138 at a rear surface 102*b* of the facestock sheet assembly 102 adjacent to the adhesive layer 134 that enhances the bonding of the adhesive layer 134 to the facestock sheet assembly 102.

The composition, and thus thicknesses, of each of the layers 119, 134, 136, 148, 138, and 113 of the label sheet assembly 100 can range in material and value, as described below. In one example embodiment, the facestock sheet 119 is a polymeric film, for example, polyolefin, polyvinylchloride, polyester, polystyrene, polyurethane, polycarbonate, or other film-forming polymers. In an alternate example embodiment, the facestock sheet 119 can be paper, synthetic paper, laminated paper, or laminated film. Where the material of the facestock sheet 119 is a film, the film can be oriented or un-oriented. In one or more embodiments, the thickness $t_{FS}$ of the facestock sheet 119 can range from approximately 1 mil to approximately 4 mils, or from approximately 1 mil to approximately 3 mils. In one example embodiment, the facestock sheet 119 is a cast polypropylene film with a thickness $t_{FS}$ of approximately 3 mils.

The carrier 113 can be, for example, a paper or polymeric film. Optionally, the carrier 113 can include a siliconized layer; paper with silicone coating; or a film with silicone coating. In one or more example embodiments, the thickness $t_{RL}$ of the carrier 113 can range from approximately 1 mil to approximately 5 mils, or from approximately 3.9 mils to approximately 4.7 mils. In one example embodiment, the carrier 113 is a machine finished 60 pound paper (60#MF) with a thickness $t_{RL}$ of approximately 4.3 mils.

The adhesive layer 134 can be, for example, acrylic-based or rubber-based. The adhesive layer 134 can also be hot melt, emulsion, or solvent-based. Suitable example adhesives for the adhesive layer 134 include permanent, removable, or ultra-removable adhesives. In one or more example embodiments, the coat weight of the adhesive layer 134 can range from approximately 4 grams per square meter ("gsm") to approximately 45 gsm, which corresponds to a thickness $t_{AL}$ range of approximately 0.2 mils to approximately 1.8 mils; or a coat weight from approximately 15 gsm to approximately 21 gsm, which corresponds to a thickness $t_{AL}$ range of approximately 0.6 mils to approximately 0.8 mils. In one embodiment, the adhesive layer 134 is made of AT-1M, which is a commercial emulsion acrylic pressure-sensitive adhesive made by Avery Dennison Corporation of Pasadena, Calif., having a coat weight of approximately 18 gsm, which corresponds to a thickness $t_{AL}$ of approximately 0.7 mils.

The optional release coating 136 can be, for example, a low surface energy material such as a silicone, wax, fluorocarbon, fluoropolymer, or any other release materials known in the art. In one or more embodiments, the coat weight of the release coating 136 can range from approximately 1 gsm to approximately 2 gsm, which corresponds to a thickness $t_{RA}$ range of approximately 0.04 mils to approximately 0.08 mils.

The optional primer layer 138 can be prepared by using, for example, a pigment and a binder. Suitable pigments include, for example, magnesium hydroxide, magnesium carbonate, magnesium sulfate, calcium oxide, calcium hydroxide, calcium carbonate, satin white, calcium silicate, zinc oxide, titanium oxide, aluminum oxide, aluminum hydroxide, talc, or kaolin. Suitable binders include, for example, starch, polyvinyl alcohol, carboxymethylcellulose, styrene-butadiene copolymer, an acrylic copolymer, or a vinyl acetate copolymer. For example, suitable primers are disclosed in U.S. Pat. No. 5,670,226 to Yoshizawa, et al., which is incorporated by reference herein in its entirety. Any number of known primers can be used. The coat weight for the adhesive layer 134 and the primer layer 138, combined, is suitably in a range from approximately 10 gsm to approximately 45 gsm, such that the thickness $t_{AL}$ of the adhesive layer 134 combined with a thickness $t_{PL}$ of the primer layer 138 ranges between approximately 0.4 mils to approximately 1.8 mils; or a coat weight from approximately 15 gsm to approximately 21 gsm, which corresponds to a combined thickness ($t_{AL}$+$t_{PL}$) range of approximately 0.6 mils to approximately 0.8 mils.

The optional ink, indicia, or print receptive or other suitable topcoat layer 148 can be, for example, any suitable inkjet coatings known to persons skilled in the art. In most cases, the optional ink, indicia, or print receptive or other suitable topcoat layer 148 includes one or more latex binders (e.g., vinyl acetate, ethylene vinyl acetate), one or more fixing agents (e.g., polyamine) and silica. In one or more embodiments, the coat weight of the ink, indicia, or print receptive layer 148 can range from approximately 1 gsm to approximately 20 gsm, which corresponds to a thickness $t_{TC}$ range of approximately 0.04 mils to approximately 0.8 mils.

The facestock sheet assembly 102 has a generally rectangular shape having two parallel long edges 103, 105 running along a length L of the label sheet assembly 100, and two parallel short edges 107, 109 running along a width W of the label sheet assembly 100, where the two parallel long edges 103, 105 are perpendicular to the two parallel short edges 107, 109. The facestock sheet assembly 102 has a plurality of labels 110 formed therein, by die-cut lines, partial die-cut lines, perforated lines including microperforated lines, lines of cuts and ties, etched lines, laser cut lines, and lines made by other techniques known in the art. In the embodiment illustrated in FIG. 1, the facestock sheet assembly 102 is shown on a front side of the label sheet assembly 100. The facestock sheet assembly 102 includes at least one label 110, with label width $W_L$ and label length $L_L$. The facestock sheet assembly 102 has cuts 108 (hereinafter "cuts," "through-cuts," or "cut lines") defining the shape or perimeter of each label 110 formed therein such as by die-cut lines, partial die-cut lines, perforated lines including micro-perforated lines, lines of cuts and ties, etched lines, laser cut lines, and lines made by other techniques known in the art.

Each label 110 has a first end 112, a second end 114, and a middle portion 116 disposed between the first end 112 and the second end 114. In an embodiment as illustrated in FIG. 1, each label 110 has four edges (126, 128, 130, and 132). The first edge 126 is disposed at the first end 112 of the label 110 in a direction parallel to the width $W_L$ of the label 110. The second edge 130 is adjacent to and perpendicular to the first edge 126 in a direction parallel to the length $L_L$ of each label 110. The third edge 128 is disposed at the second end 114 of the label 110, adjacent to and perpendicular to the second edge 130 and parallel with and opposite to the first edge 126. The fourth edge 132 is adjacent to and perpendicular to the first edge 126 and the third edge 128 in a direction parallel to the second edge 130 of each label 110. The four edges (126, 128, 130, and 132) of each label 110 define the shape or perimeter of the label 110. In the embodiment illustrated in FIGS. 1 and 2, the shape of each label 110 is substantially rectangular, but the exact shape or perimeter profile of the label 110 can be any shape suitable for use as a label. For example, the label 110 can generally have a rounded shape, a circular or semi-circular shape, a square shape, an elliptical shape, a triangular shape, a pentagonal shape, or other shapes.

The section of the facestock sheet assembly 102 not used for labels 110 constitutes the border 106 (hereinafter, "border" or "matrix") having a width $W_S$ between adjacent labels 110, and a width $W_E$ between each of the long edges 103, 105 of the facestock sheet assembly 102 and each of the labels 110 at either of the long edges 103, 105; and a length $L_E$ between the first edge 126 of each label 110 and the short edge 107, and between the third edge 128 of each label 110 and the short edge 109 of the facestock sheet assembly 102. In the figures, the facestock sheet assembly 102 is shown having a shorter length and width than the release liner assembly 104, although it is not necessary that the facestock sheet assembly 102 have a shorter length and width than the release liner assembly 104. Additionally, although the label sheet assembly 100 is shown with a matrix 106, it is not necessary for the invention that the label sheet assembly 100 includes a matrix 106 surrounding and/or between labels 110.

Figure 2A:
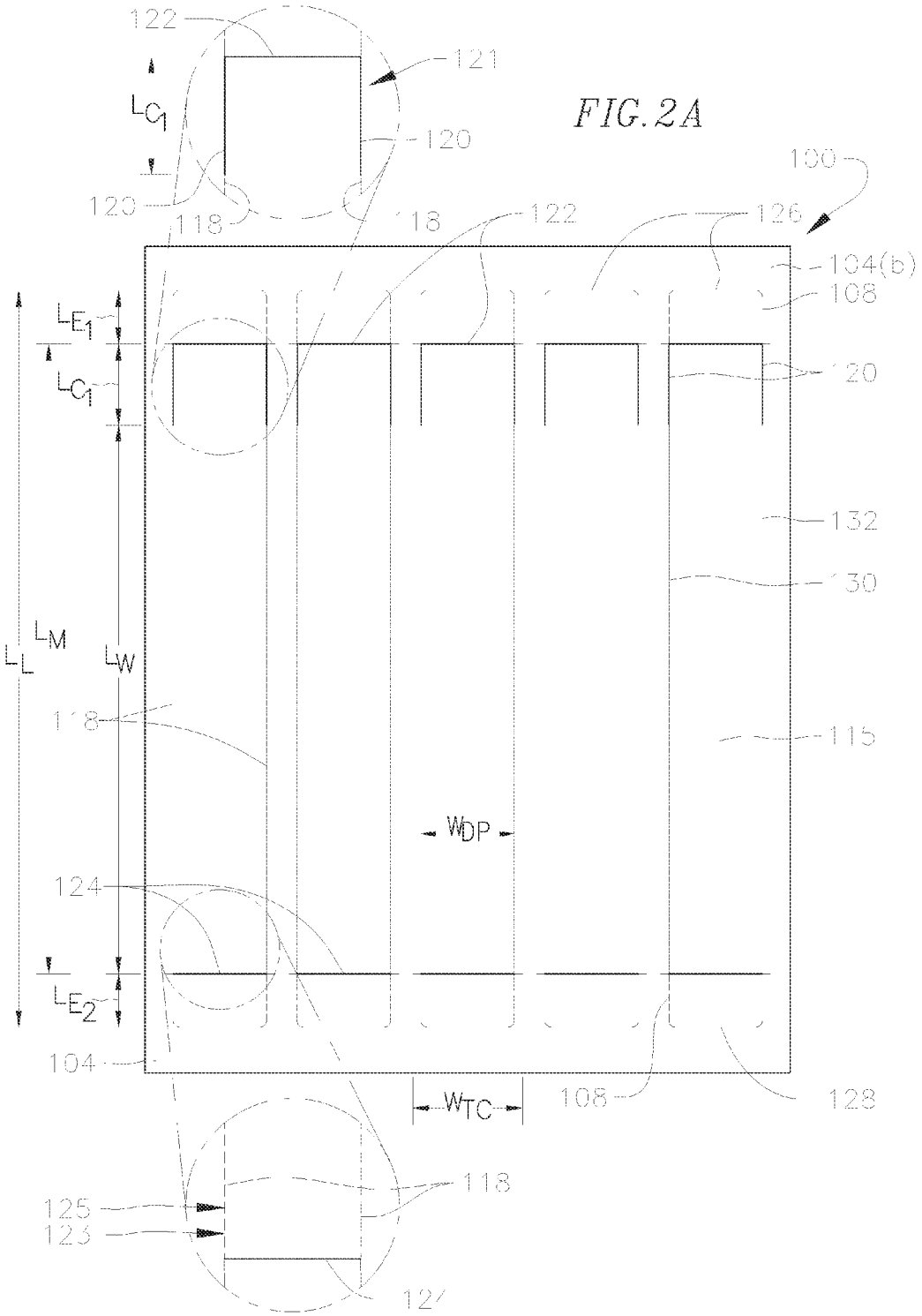
FIG. 2A is a bottom plan view of the label sheet assembly of FIG. 1 further including enlarged bottom plan views of the first end and the second end of a label shown in phantom.
Figure 2B:
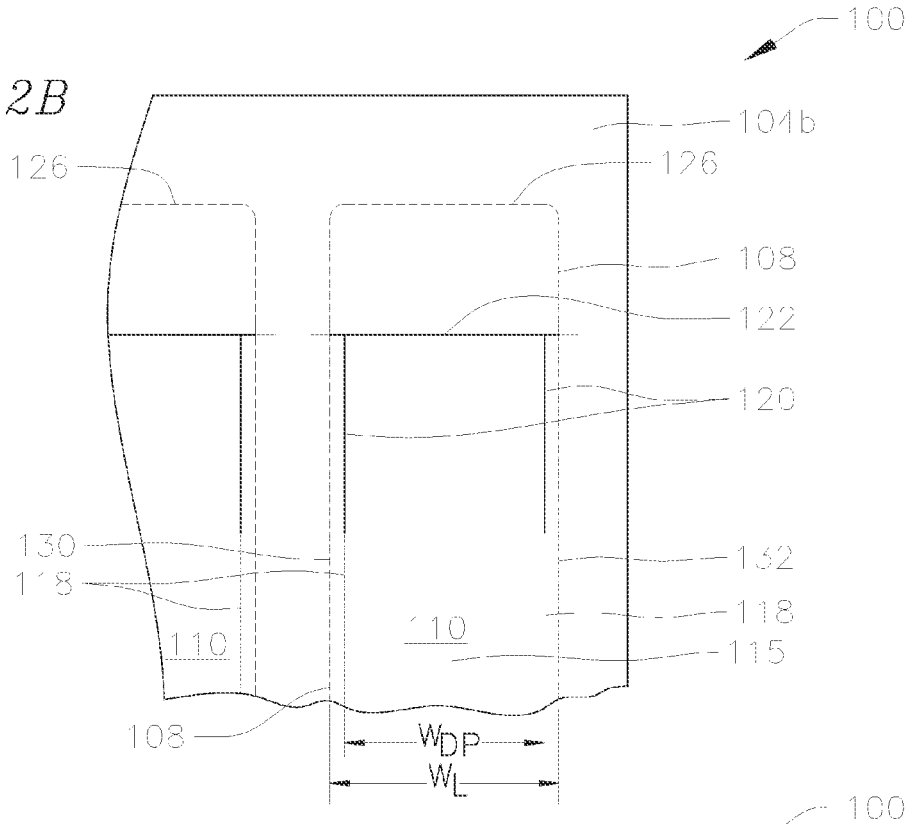
FIG. 2B is a partial bottom plan view of a label sheet assembly according to another embodiment of the present invention, showing weakened separation lines and tine-cut lines in the release liner offset from cuts in the facestock sheet.
Figure 3A:
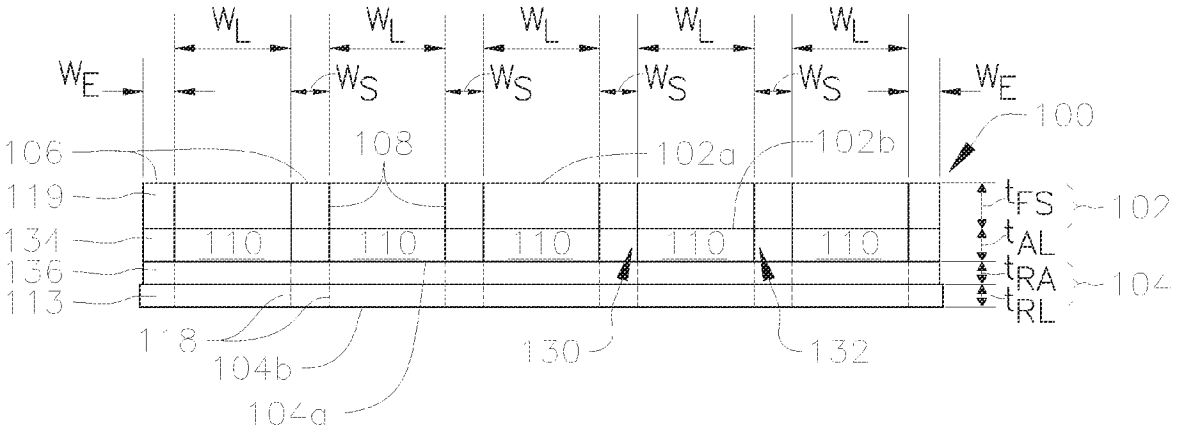
FIGS. 3A and 3B are cross-section views taken along section lines A-A and B-B, respectively, of FIG. 1 according to one embodiment of the present invention.
Figure 3B:
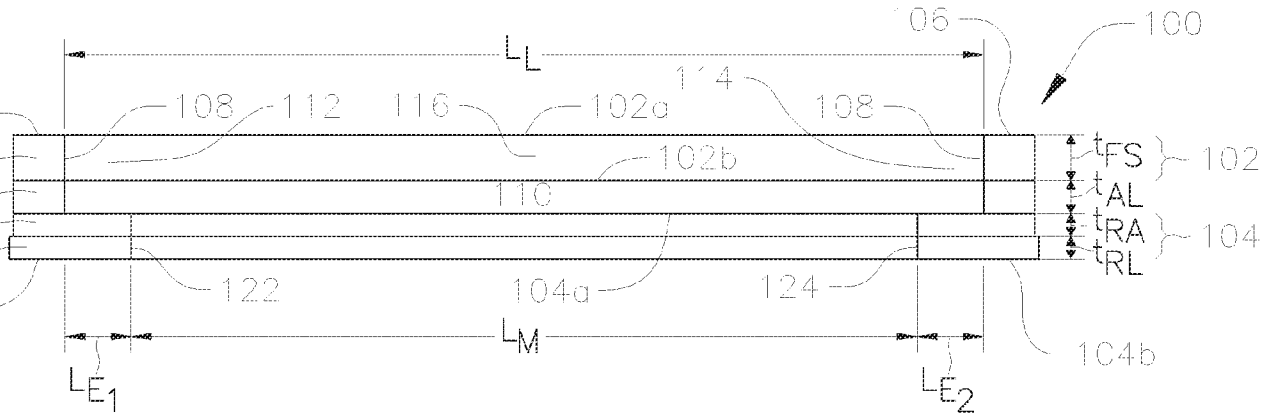
Figure 4A:
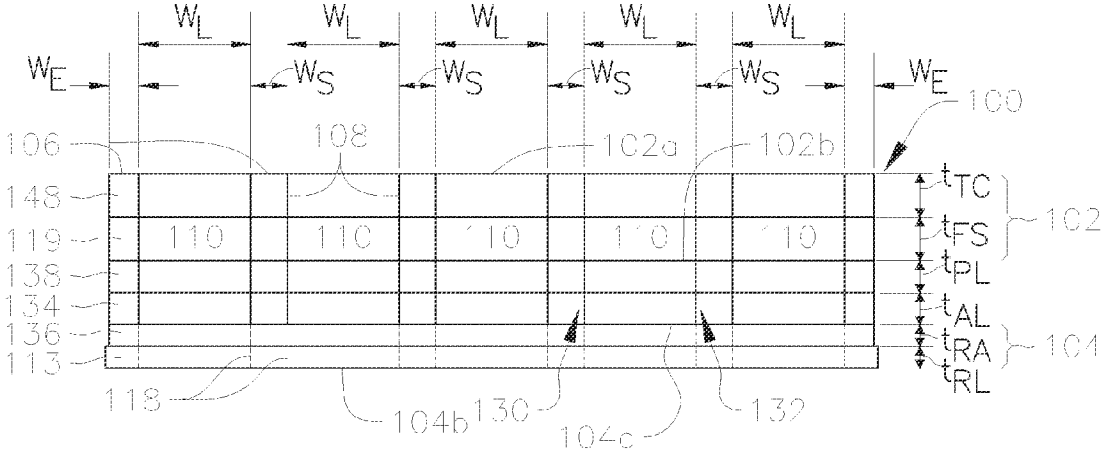
FIGS. 4A and 4B are cross-section views taken along section lines A-A and B-B, respectively, of FIG. 1, according to another embodiment of the present invention.
Figure 4B:
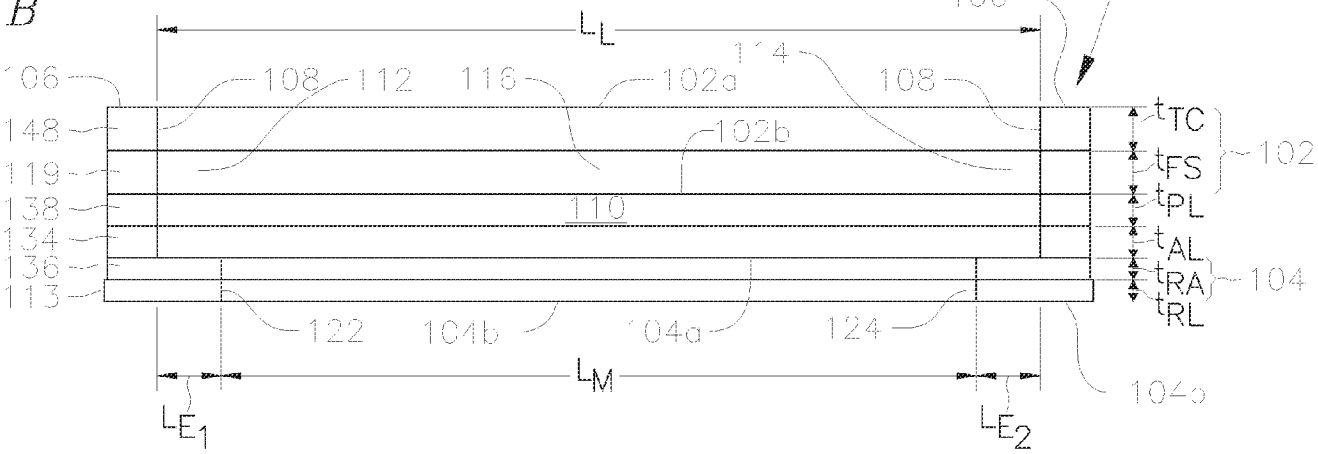

As illustrated in FIG. 2A, the release liner assembly 104 is shown on a back side of the label sheet assembly 100. The first and second ends 112, 114, respectively, of the labels 110 are shown in phantom in FIG. 2A. The release liner assembly 104 has weakened separation lines 118, for example, perforated cuts or a plurality of cuts 125 and a plurality of ties 123 formed therein by die-cut lines, partial die-cut lines, perforated lines including micro-perforated lines, lines of cuts and ties, etched lines, laser cut lines, and lines made by other techniques known in the art. In one example embodiment, the weakened separation lines 118 underlie a portion of the cut lines 108 along the second edge 130 and fourth edge 132 of each label 110 as shown in FIGS. 3A and 4A. In another example embodiment, the weakened separation lines 118 are slightly offset from the cut lines 108 in the facestock sheet assembly 102, as shown in FIG. 2B. The weakened separation lines 118 in the release liner assembly 104 have a length $L_W$ less than the overall length of the label $L_L$ as shown in FIGS. 3B and 4B.

The release liner assembly 104 further includes a plurality of U-shaped cuts 121. Each U-shaped cut 121 includes a first transverse cut 122 and a pair of longitudinal tine-cuts 120 (hereinafter "longitudinal tine-cuts" or "tine-cuts") intersecting the first transverse cut 122 and each extending a length $L_{C1}$ from the first transverse cut 122. In one example embodiment, the pair of longitudinal tine-cuts 120 are co-linear with and adjacent to the weakened separation lines 118 and underlie a portion of the cut lines 108 along the second edge 130 and the fourth edge 132 of each label 110. Optionally, one or both of the tine-cuts 120 and the weakened separation lines 118 can be offset from the cuts 108 in the facestock sheet assembly 102. In one example embodiment illustrated in FIG. 2B, the pair of longitudinal tine-cuts 120 are co-linear with and adjacent to the weakened separation lines 118, and both the tine-cuts 120 and the weakened separation lines 118 are slightly offset inward from the cut lines 108 along the second edge 130 and the fourth edge 132 of each label 110. In an alternate example embodiment illustrated in FIG. 2C, both the tine-cuts 120 and the weakened separation lines 118 are offset inward from the cut lines 108 along the second edge 130 and the fourth edge 132 of each label 110, and the tine-cuts 120 are slightly offset inward from the weakened separation lines 118. A person of ordinary skill in the art will appreciate that the tine-cuts 120 can be offset from the weakened separation lines 118 a sufficiently small distance, such as less than approximately 2 mm, such that the weakened separation lines 118 tear when the label 110 is peeled from the label sheet 100 in a first direction 140, as described below. Furthermore, a person of ordinary skill in the art will appreciate that the tine-cuts 120 can be slightly offset outward from the weakened separation lines 118.

The release liner assembly 104 also includes a plurality of second transverse cuts 124. Each second transverse cut 124 intersects the pair of weakened separation lines 118. Together, the pairs of longitudinal tine-cuts 120 and the weakened separation lines 118 extend completely between the first transverse cuts 122 and the second transverse cuts 124. Each of the first and second transverse cuts 122, 124 spans at least the width $W_L$ of the overlying label 110 such that the length of the first and second transverse cuts 122, 124 can extend beyond the pair of longitudinal tine-cuts 120 and the weakened separation lines 118, respectively.

Figure 2C:
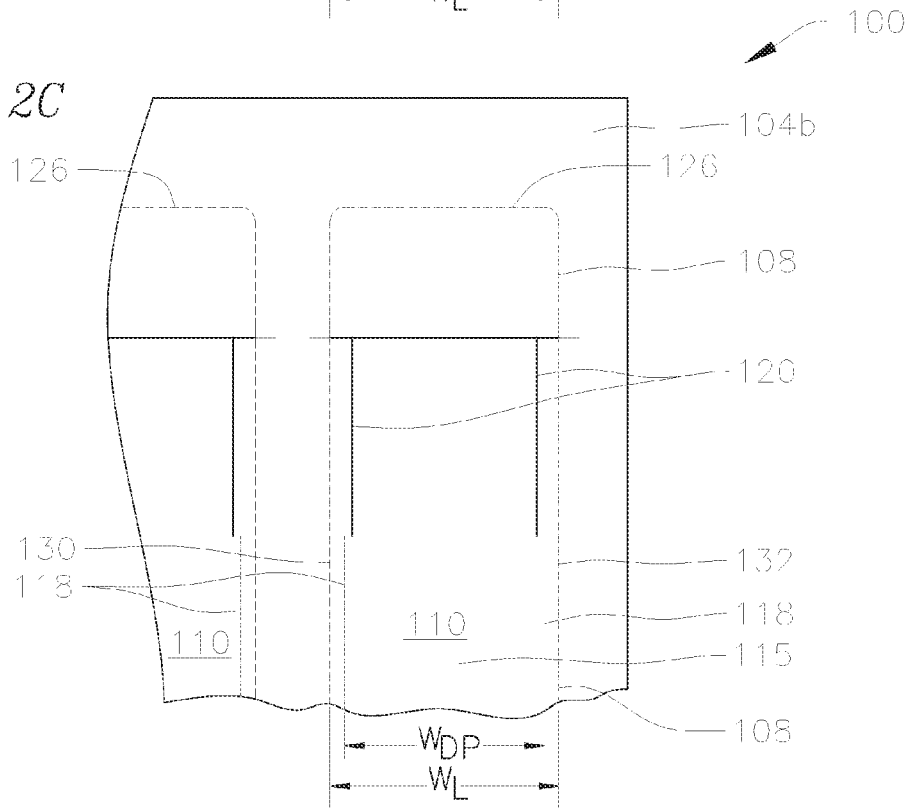
FIG. 2C is a partial bottom plan view of a label sheet assembly according to another embodiment of the present invention, showing weakened separation lines offset from tine-cut lines in the release liner.

With continued reference to FIG. 2A, detachable portions 115 of the release liner assembly 104 are defined by areas bounded by the U-shaped cuts 121, the second transverse cuts 124, and the weakened separation lines 118. The middle portions 116 of the labels 110 overlie the detachable portions 115 of the release liner assembly 104. The detachable portions 115 each have a length $L_M$ defined by the combined length $L_{C1}$ of the tine-cuts 120 and the length $L_W$ of the weakened separation lines 118 in the release liner assembly 104. Although in the example embodiment of FIG. 2A, a width $W_{DP}$ of the detachable portions 115 of the release liner assembly 104 is equal to the width $W_L$ of the labels 110, the width $W_{DP}$ of the detachable portions 115 of the release liner assembly 104 can be less than the width $W_L$ of the labels 110, as shown in FIGS. 2B and 2C. The first transverse cuts 122 and second transverse cuts 124 underlie and delineate the first ends 112 from the middle portions 116, and the middle portions 116 from the second ends 114, respectively, of the overlying labels 110, as shown in FIGS. 3B and 4B. The first transverse cut 122 is at a distance $L_{E1}$ from the first edge 126 of the overlying label 110, and the second transverse cut 124 is at a distance $L_{E2}$ from the third edge 128 of the overlying label 110. As illustrated in FIG. 2A, a width $W_{TC}$ of each of the first and second transverse cuts 122, 124 in the release liner assembly 104 are at least as wide as the width $W_L$ of each overlying label 110. Accordingly, the first and second transverse cuts 122, 124 are configured to ensure that the first end 112 and the second end 114 of the label 110 separate from the release liner assembly 104 when the label is peeled from the label sheet assembly 100 as described in further detail below.

The label sheet assembly 100 is preferably an overall standard size such as 8 and ½ inches by 11 inches, or A4 (approximately 8.3 inches×11.7 inches), or 4 inches by 6 inches, or other sizes W×L compatible with standard printers used with personal computers. In one embodiment as illustrated in FIGS. 1 and 2, the label sheet assembly 100 has five labels 110 equally spaced apart on the label sheet assembly 100, although it will be appreciated that any other suitable number of labels 110 can be provided on the label sheet assembly 100 without departing from the spirit and scope of the present invention. Each label 110 in the example suitably has an overall length $L_i$, of approximately 9 and ¾ inches, an overall width $W_L$ of approximately 1 and ¼ inches, first and second transverse cut lengths $L_{E1}$ and $L_{E2}$ of each approximately ¾ inch, longitudinal tine-cuts 120 of length $L_{C1}$ approximately 1 and 1/16 inches, and a remaining weakened separation line 118 length of approximately 7 and 5/16 inches including a plurality of ties of each ranging between approximately 0.02 inches and 0.03 inches and a plurality of cuts of each approximately 7/64 inch. A person of ordinary skill in the art will appreciate that other suitable dimensions can also be employed for various embodiments of the label 110.

Figures 5A, 5B:
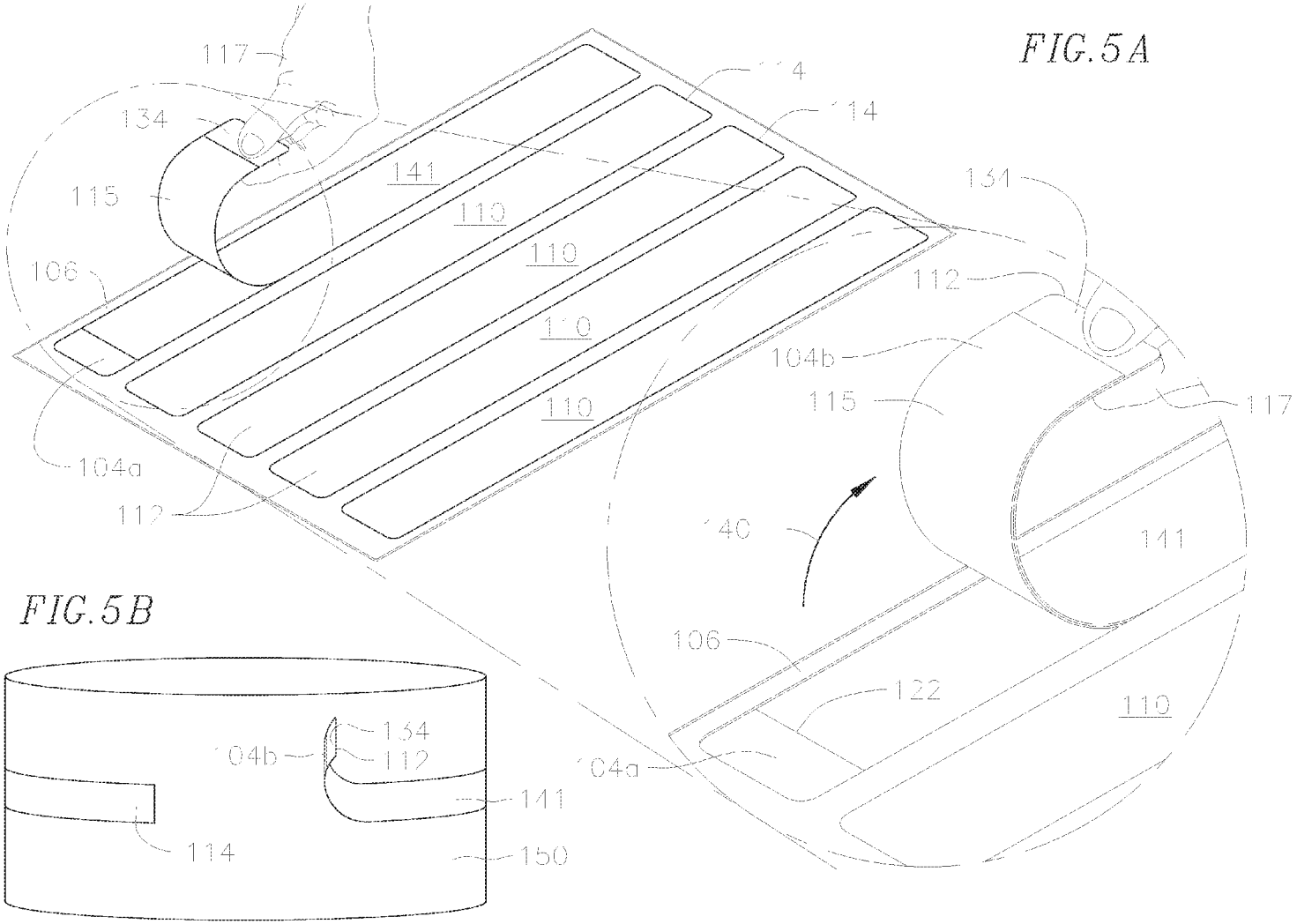
FIG. 5A is a top perspective illustration showing how a label from the label sheet assembly illustrated in FIG. 1 can be removed from a first direction, according to one embodiment of the present invention.
FIG. 5B is an illustration showing how the label removed in FIG. 5A can be applied to a surface according to one method of the present invention.

FIG. 5A illustrates the removal or separation of a label 141 peeled from the label sheet assembly 100 by a user 117 in a first direction 140, according to one embodiment of the present invention. Peeling the label 141 from its first end 112 in the first direction 140 results in a label 141 with exposed adhesive 134 at both the first end 112 and the second end 114 and with the detachable portion 115 of the release liner assembly 104 releasably adhered to the middle portion 116 of the label 141.

As the user 117 begins to peel the label 141 in the first direction 140, the first end 112 of the label 141 separates from the release liner assembly 104 underlying the first end 112, thereby exposing the adhesive layer 134 at the first end 112 of the label 141. As the user 117 continues to peel the label 141 in the first direction 140, the U-shaped cut 121 in the release liner assembly 104 causes the detachable portion 115 of the release liner assembly 104 to begin lifting along with the label 141. The adhesive force between the label 141 and the detachable portion 115 is sufficient to keep the detachable portion 115 attached to the label 141 as the peeling of the label 141 progresses past the first transverse cut 122.

The adhesive force between the detachable portion 115 of the release liner assembly 104 and the label 141 is sufficient to tear the weakened separation lines 118 (e.g., the perforations or the plurality of cuts 125 and the plurality of ties 123). Accordingly, the weakened separation lines 118 tear and the detachable portion 115 of the release liner assembly 104 remains releasably adhered to the middle portion 116 of the label 110 as the peeling of the label 141 progresses toward the second transverse cut 124. That is, because the detachable portion 115 of the release liner assembly 104 defined by the U-shaped cut 121 lifts along with the label 141, the weakened separation lines 118 tear and the detachable portion 115 of the release liner assembly 104 remains adhered to the label 141 as the label 141 is peeled in the first direction 140. The detachable portion 115 of the release liner assembly 104 continues to lift with the label 141 all the way through until the second transverse cut 124. A person of ordinary skill in the art will appreciate that the length $L_{C1}$ of each of the tine-cuts 120 can be any suitable length, for example, approximately 1 and 1/16 inches, such that the adhesion between the detachable portion 115 of the release liner assembly 104 and the label 141 causes the weakened separation lines 118 to tear when the label 141 is peeled in the first direction 140.

As the peeling of the label 141 reaches the second transverse cut 124, the detachable portion 115 of the release liner assembly 104 completely separates from the label sheet assembly 100 and remains releasably adhered to the middle portion 116 of the label 141. As the user 117 continues to peel the label 141 past the second transverse cut 124 in the release liner assembly 104, the second end 114 of the label 141 separates from the portion of the release liner assembly 104 underlying the second end 114, thereby exposing the adhesive 134 on the second end 114 of the label 141. Accordingly, after the label 141 is completely removed from the label sheet assembly 100, adhesive 134 is exposed at both the first end 112 and the second end 114, while the detachable portion 115 of the release liner assembly 104 remains releasably adhered to the middle portion 116 of the label 141. A person of ordinary skill in the art will appreciate that the detachable portion 115 of the release liner assembly 104 releasably adhered to the middle portion 116 of the label 141 can be peeled off the label 141 to expose adhesive 134 along the entire length $L_L$ of the label 141.

With reference now to FIG. 5B, after the label 141 is detached completely from the label sheet assembly 100, the label 141 can be applied to a surface using the exposed adhesive 134 at the first end 112 and the second end 114. In an exemplary use of the label 141 after it has been removed from the label sheet assembly 100, the label is applied to a surface, e.g., a cylindrical surface 150, such that only the first end 112 and second end 114 are adhered to the surface 150 via the adhesive layer 134. The label 141 removed from the first direction 140 and applied to a surface 150 according to this embodiment is configured to have a conformable, smoother surface with less contour lines or wrinkling due to the combined thickness of the label 141 and the detachable portion 115 of the release liner assembly 104. A person of ordinary skill in the art will appreciate that the label 141 removed from the label sheet assembly 100 in the first direction 140, is not limited to the uses described herein.

Figures 6A, 6B:
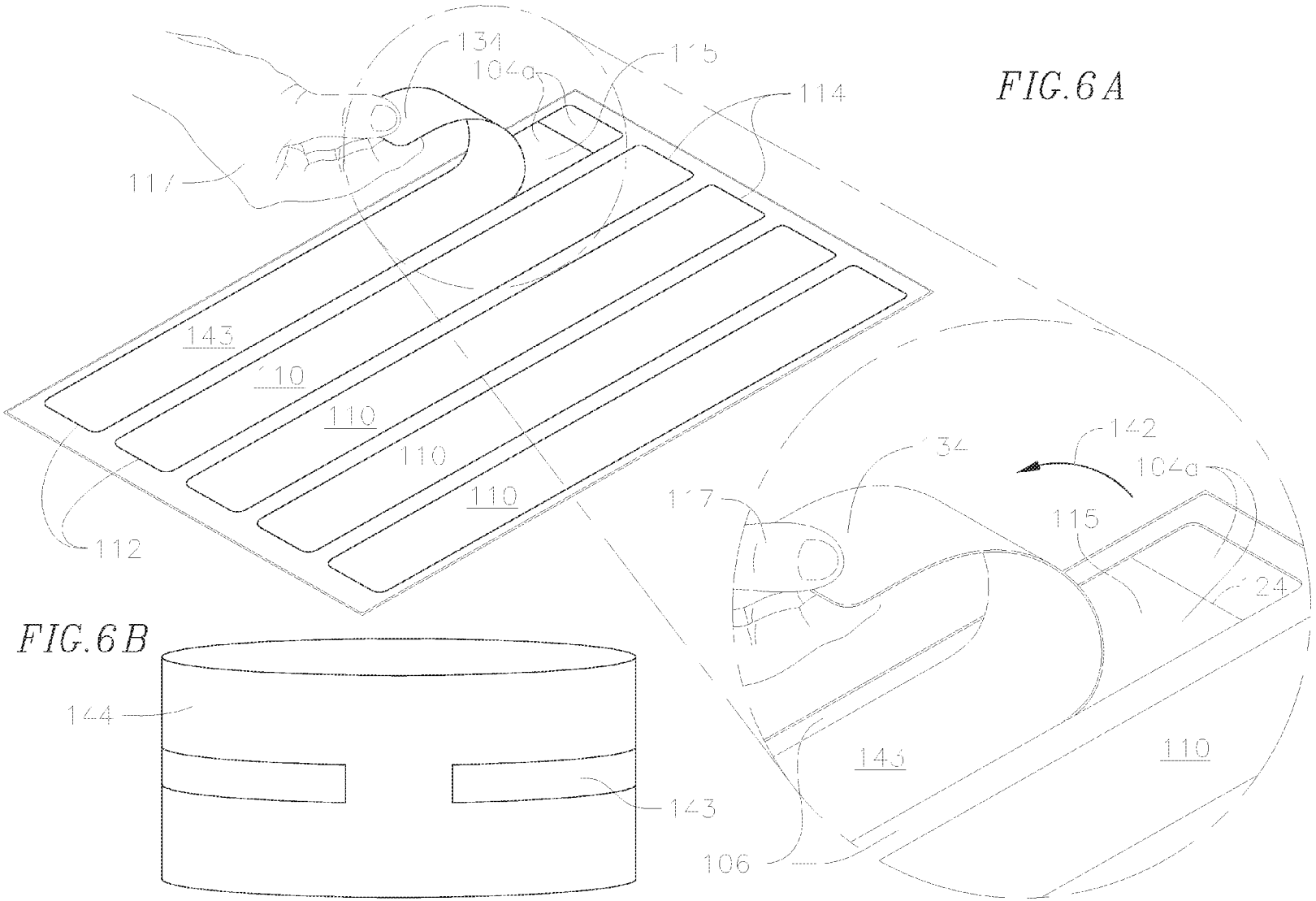
FIG. 6A is a top perspective illustration showing how a label from the label sheet assembly illustrated in FIG. 1 can be removed from a second direction, according to one method of the present invention.
FIG. 6B is an illustration showing how the label removed in FIG. 6A can be applied to a surface according to one method of the present invention.

FIG. 6A illustrates the removal or separation of a label 143 peeled from the label sheet assembly 100 by a user 117 in a second direction 142, opposite the first direction 140, according to another example embodiment of the present invention. Peeling the label 143 from its second end 114 in the second direction 142 results in a label 143 with exposed adhesive 134 along the entire length $L_L$ of the label 143, including the first end 112, the second end 114, and the middle portion 116.

As the user 117 begins to peel the label 143 in the second direction 142, the second end 114 of the label 143 separates from the release liner assembly 104 underlying the second end 114, thereby exposing the adhesive layer 134 at the second end 114 of the label 143. As the peeling of the label 143 reaches the second transverse cut 124, the label 143 begins to separate from the detachable portion 115 of the release liner assembly 104. Unlike peeling the label 141 in the first direction 140, during which the U-shaped cut 121 in the release liner assembly 104 causes the detachable portion 115 of the release liner assembly 104 to begin lifting along with the label 141 and thereby causes the weakened separation lines 118 to tear, peeling the label 143 in the second direction 142 does not tear the weakened separation lines 118, enabling the detachable portion 115 of the release liner assembly 104 to remain attached to the remainder of the label sheet assembly 100. Accordingly, as the user 117 continues to peel the label 143 in the second direction 142, the middle portion 116 of the label 143 separates from the detachable portion 115 of the release liner assembly 104 all the way until the first transverse cut 122 is reached.

As the user 117 continues to peel the label 143 past the first transverse cut 122 in the release liner assembly 104, the first end 112 of the label 143 separates from the portion of the release liner assembly 104 underlying the first end 112, thereby exposing the adhesive 134 on the first end 112 of the label 143. Accordingly, after the label 143 is completely removed from the sheet assembly 100, adhesive 134 is exposed along the entire length $L_L$ of the label 143 (i.e., adhesive 134 is exposed at the first end 112, the second end 114, and the middle portion 116), while the detachable portion 115 of the release liner assembly 104 remains attached to the remainder of the label sheet assembly 100. Thus, peeling the label 143 from the label sheet assembly 100 in the second direction 142, unlike peeling the label 141 from the label sheet assembly 100 in the first direction 140, results in a label 143 having no portion of the release liner assembly 104 attached thereto.

With reference now to FIG. 6B, after the label 143 is detached completely from the label sheet assembly 100, the label 143 can be applied to a surface using the exposed adhesive 134 spanning the entire length $L_L$ of the label 143. In an exemplary use of the label 143 after it has been removed from the label sheet assembly 100, the label is applied to a surface, e.g., a cylindrical surface 144, such that the first end 112, the second end 114, and the middle portion 116 are adhered to the surface 144 via the adhesive layer 134. The label 143 removed in the second direction 142 and applied to a surface 144 according to this embodiment is configured to adhere along its entire length $L_L$ to the surface 144. It should be appreciated by those skilled in the art that the label 143, as removed from the second direction 142, is not limited to the uses described herein.

In one embodiment, the label sheet assembly 100 can include printed indicia, for example on the matrix 106 or on the release liner assembly 104 on the back side of the label sheet assembly 100, indicating the differential bi-directional peel when the labels 110 are removed in the first or second direction 140, 142, respectively. For example, the printed indicia can include arrows or textual instructions directing a user 117 to peel the label 141 from the first direction 140 to expose only a portion of the adhesive 134, or to peel the label 143 from the second direction 142 to expose the adhesive 134 along the entire length $L_L$ of the label 143.

Figure 7:
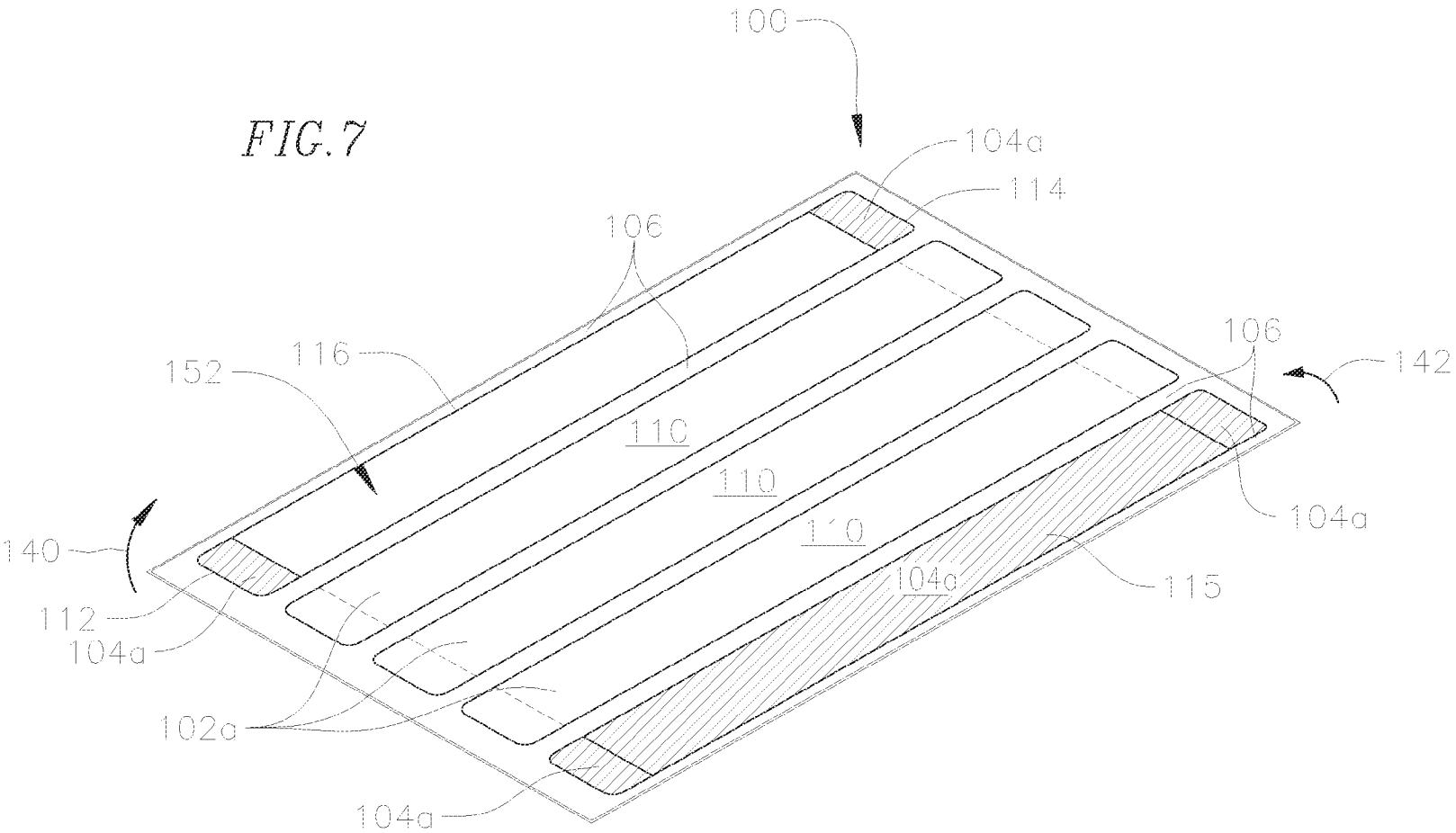
FIG. 7 is a front perspective view showing the label sheet assembly illustrated in FIG. 1 after a label has been removed from the label sheet assembly from each of the first and second directions as illustrated in FIGS. 5A and 6A, respectively.

With reference now to FIG. 7, a front perspective view is shown of the label sheet assembly 100 illustrated in FIG. 1 after two of the labels 141, 143 have been removed from the label sheet assembly 100, one label 141 removed in the first direction 140, and the other label 143 removed in the second direction 142, as shown in FIGS. 5A and 6A, respectively. After a label 141 is removed from the label sheet assembly 100 in the first direction 140 as shown in FIG. 5A, the release liner assembly 104 underlying the first end 112 and the second end 114 of the label 141 remains attached to the label sheet assembly 100, while the detachable portion 115 of the release liner assembly 104 underlying the middle portion 116 of the label 141 is detached from the label sheet assembly 100 such that an opening 152 is defined in the label sheet assembly 100. After a label 143 is removed from the label sheet assembly 100 in the second direction 142 as shown in FIG. 6A, the release liner assembly 104 underlying the first end 112, the second end 114, and the middle portion 116 of the label 143 remains attached to the remainder of the label sheet assembly 100.

Figure 8:
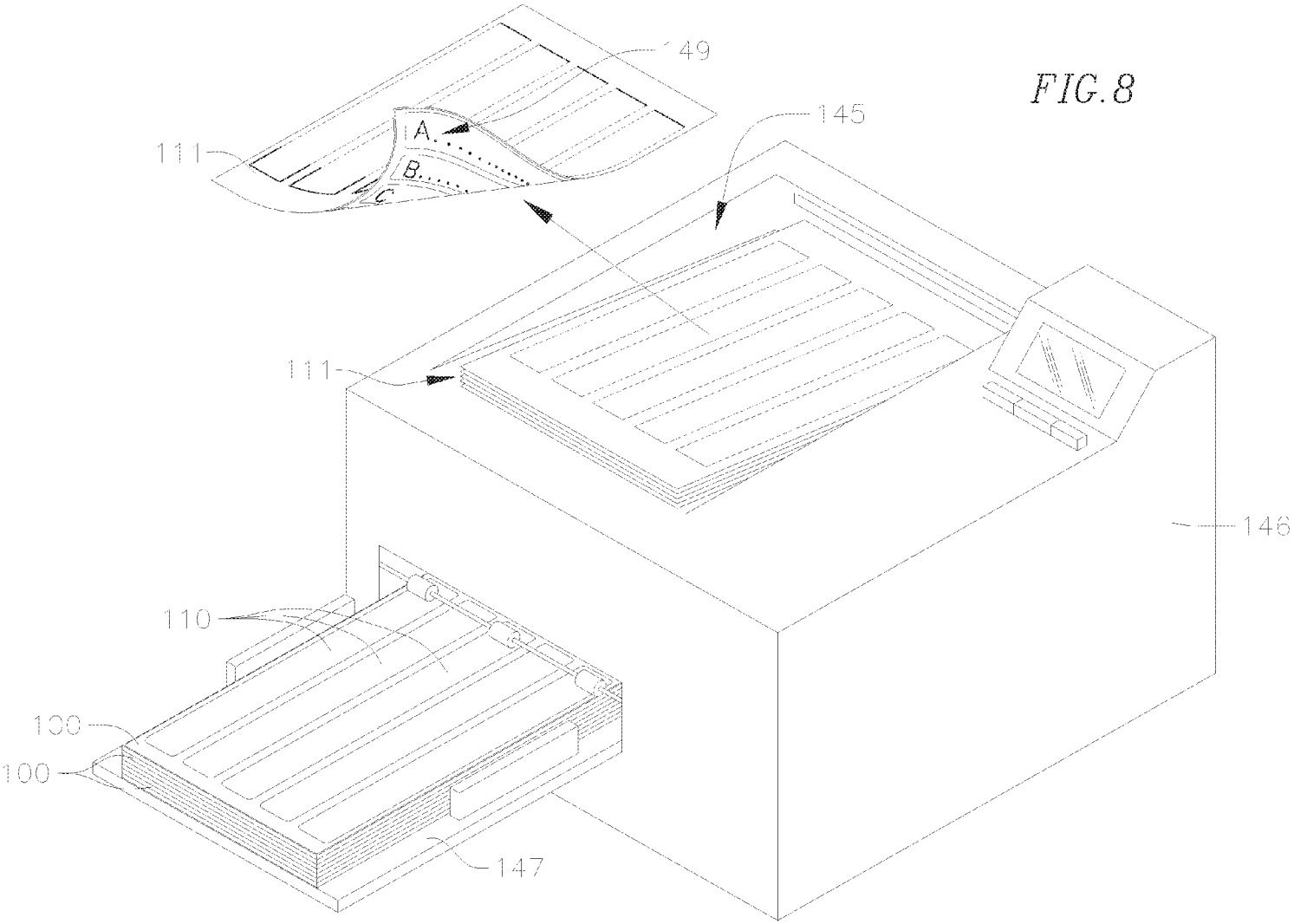
FIG. 8 is a perspective view of a printer (or copier) showing a stack of the label sheet assemblies of FIGS. 1 and 2 in an input tray of the printer and in an output tray of the printer after indicia have been printed on at least one label.

With reference now to FIG. 8, a stack of label sheet assemblies 100 can be placed in an input tray 147 of a printer (or copier) 146. Desired indicia 149 can be printed on at least one label 110 of a label sheet assembly 100 by the printer (or copier) 146 before the labels 110 are removed or detached from the label sheet assembly 100 in either a first direction 140 or a second direction 142. Label sheet assemblies 111 having the desired indicia 149 printed on at least one label 110 are shown in an output tray 145 of the printer 146 in FIG. 8.

Figure 9A:
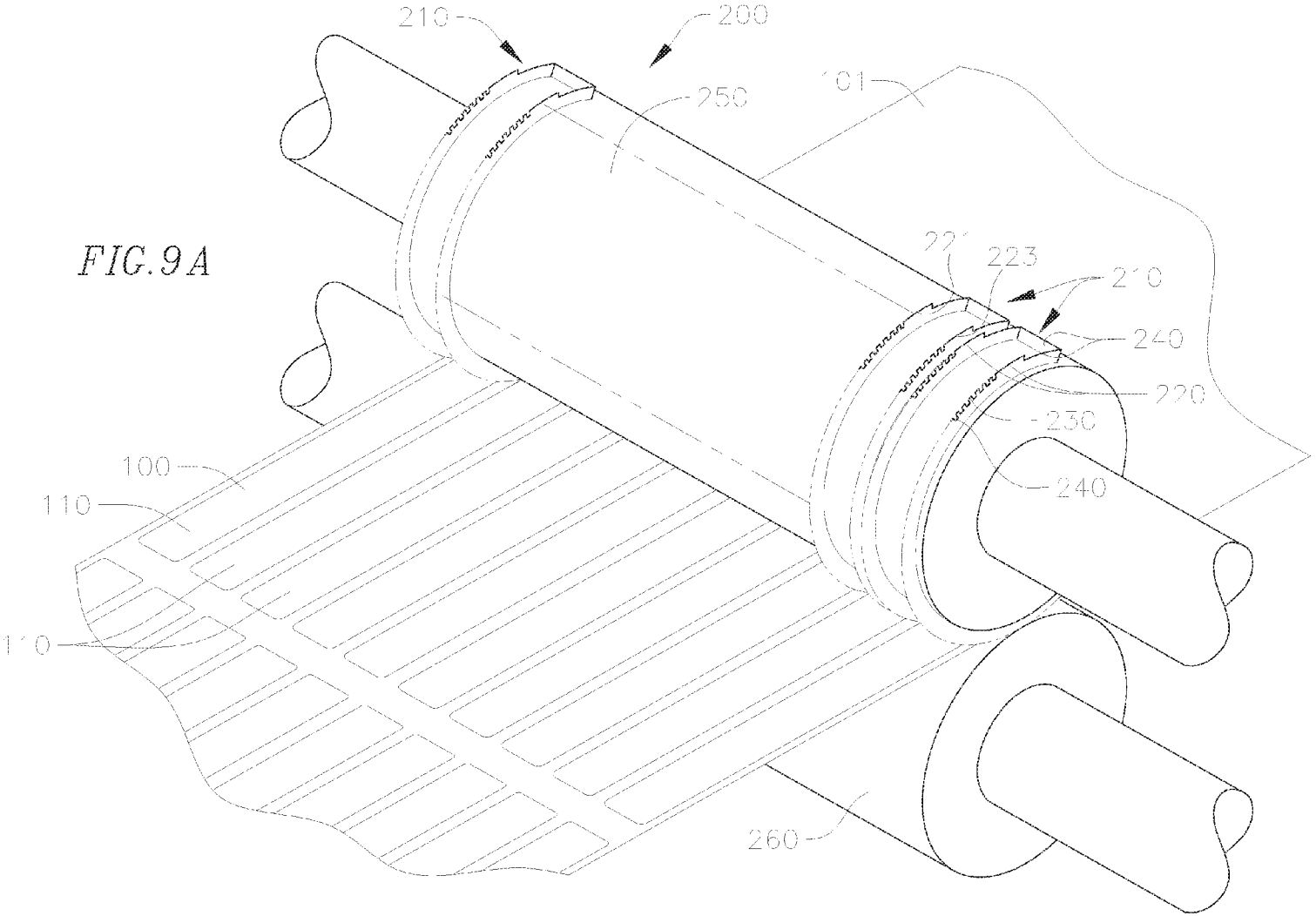
FIGS. 9A and 9B are a perspective view and a side view, respectively, of a roll process die station during a manufacturing step of a label sheet assembly according to one method of the present invention.
Figure 9B:
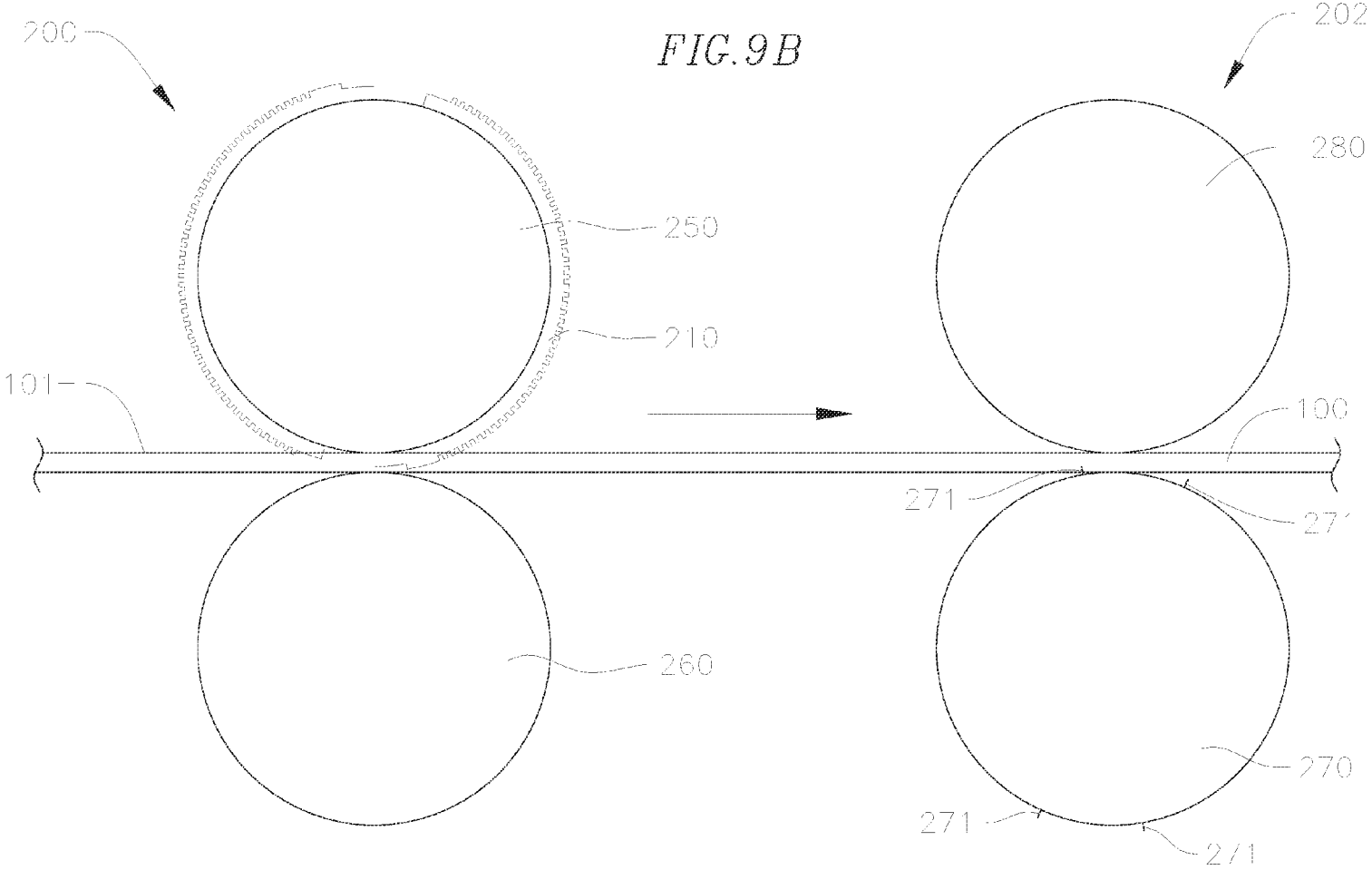
Figure 9C:
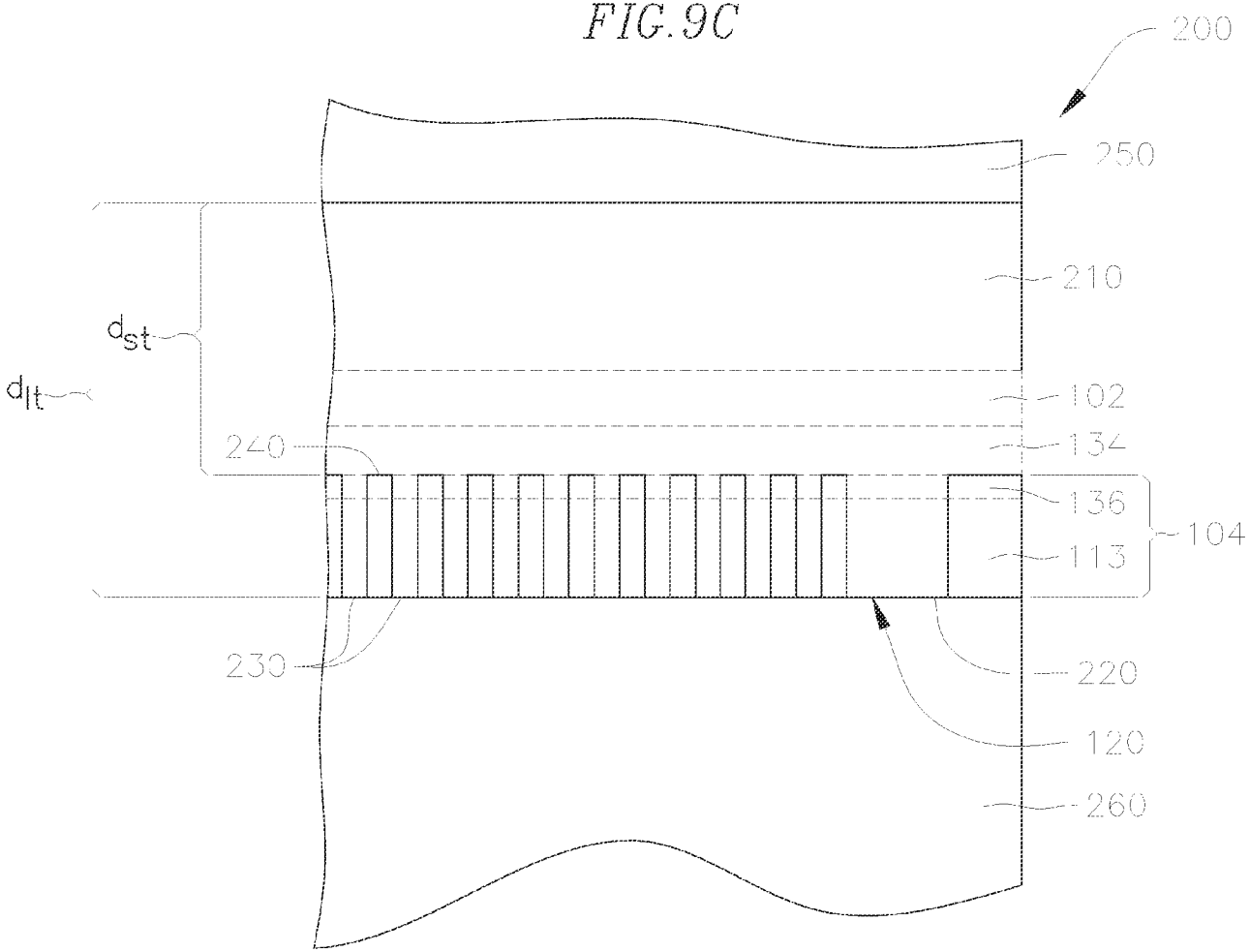
FIG. 9C is an expanded cross-section of a bi-level die used in the roll process of FIGS. 9A and 9B with portions of a label sheet assembly of the present invention shown in phantom.
Figure 10:
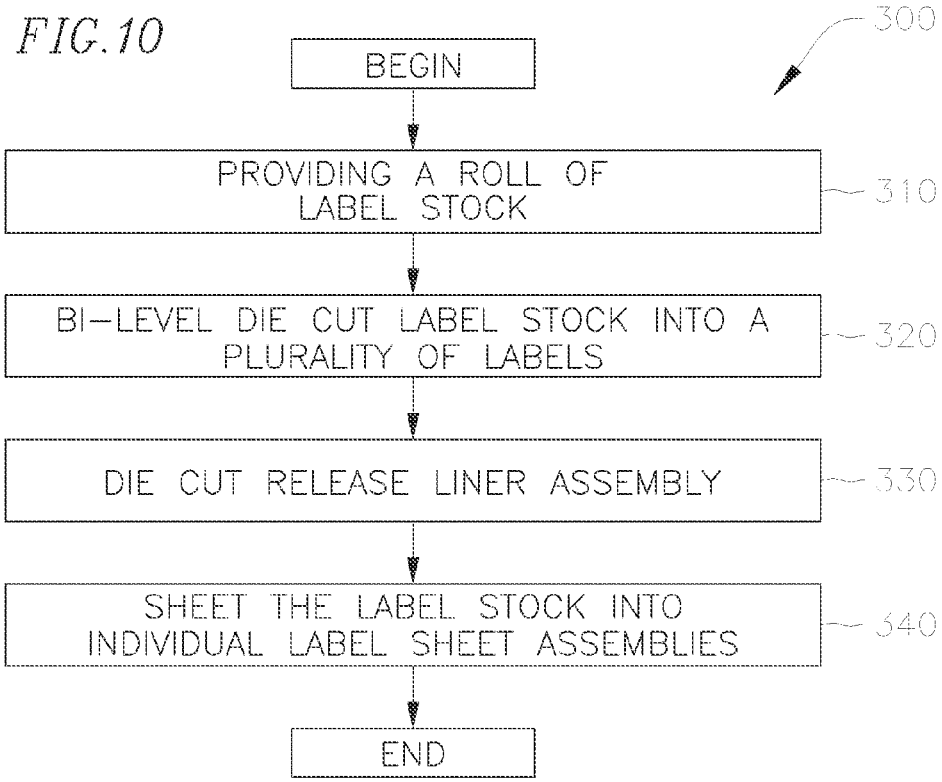
FIG. 10 is a flowchart of one method of manufacturing a label sheet assembly according to the present invention.
Figure 11:
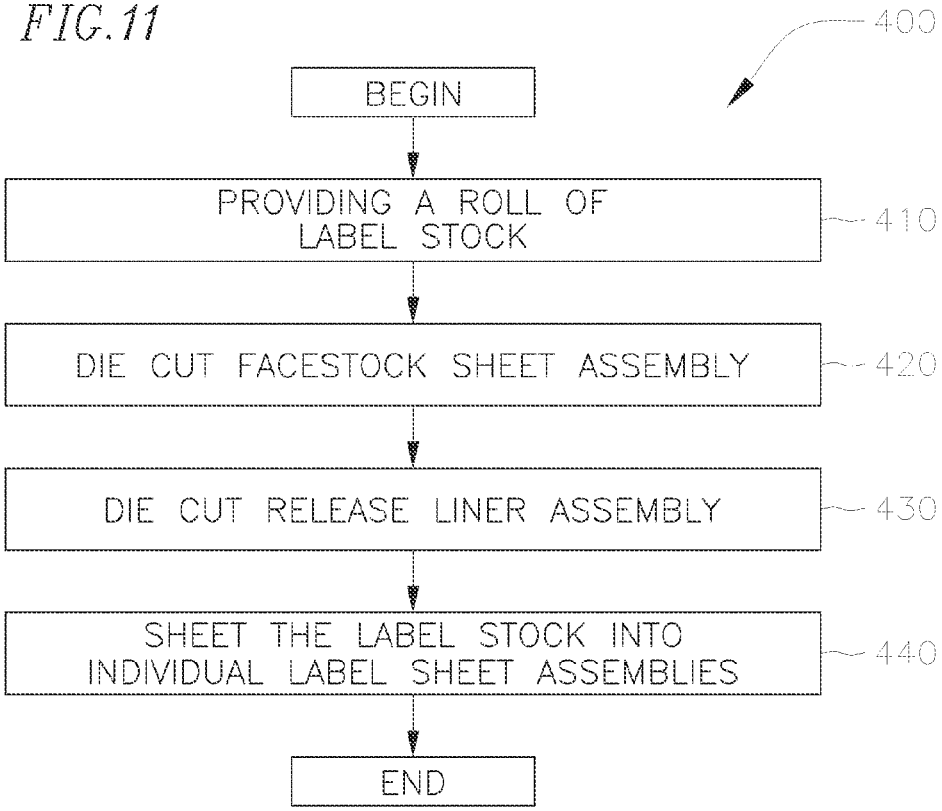
FIG. 11 is a flowchart of another method of manufacturing a label sheet assembly according to the present invention.

FIGS. 9-11 describe a method of manufacturing the label sheet assembly 100 of the present invention. With reference now to FIGS. 9-10, a label stock 101 from which individual label sheet assemblies 100 are sheeted (as described in FIG. 10 at 340) is shown entering a die station 200 where cuts in the facestock sheet assembly 102 and/or the release liner assembly 104 defining the shape of the labels 110 and the shape of the detachable portion 115 of the release liner assembly 104 will be made. The label stock 101 enters a die station (for example, the bi-level die station 200 shown in FIGS. 9A and 9B) having a knife roll cylinder 250 adjacent the top surface of the label stock 101 and a backing roll or anvil 260 adjacent to the bottom surface of the label stock 101, such that the label stock 101 is disposed between the knife roll cylinder 250 and the backing roll or anvil 260. The knife roll cylinder 250 has knives or blades 210 that cut through and/or perforate the label stock 101 to define the shape or perimeter of the labels 110 and the detachable portion 115 of the release liner assembly 104 of the label sheet assembly 100 as the label stock 101 moves through the die station 200. The knives 210 on the knife roll cylinder 250 illustrated in FIG. 9A are enlarged to show detail. In one example embodiment, the knives 210 are bi-level knives. In an alternate example embodiment, the knives 210 are single-level knives that cut to a single depth.

FIG. 9C shows an expanded cross-section of a bi-level die station 200 having a bi-level knife or blade 210 having a plurality of shorter teeth 240 and a plurality of longer teeth 230, 220. The shorter teeth 240 extend a distance $d_{st}$ from the knife roll cylinder 250 less than a distance $d_{lt}$ the longer teeth 230, 220 extend from the knife roll cylinder 250. In the example embodiment shown in FIG. 9C, a label stock 101 having a facestock sheet assembly 102, an adhesive layer 134, a release coating 136, and a release liner assembly 104, is shown in phantom along the cross-section of the bi-level knives or blades 210 for reference. The shorter teeth 240 are designed to cut through the facestock sheet assembly 102, making through-cuts 108 (as shown in FIG. 1) defining the shape or perimeter of the labels 110 formed on each label sheet assembly 100. The shorter teeth 240 extend though the facestock sheet assembly 102 as well as the adhesive layer 134 and any optional layers disposed on the front surface 102*a* of the facestock sheet assembly 102.

With continued reference to FIG. 9C, the plurality of longer teeth 230, 220 are configured to cut through the facestock sheet assembly 102 and the adhesive layer 134 (and any option layers therebetween), and to create weakened separation lines 118, e.g., perforations through a series of cuts 125 (as shown in FIG. 2A), on the release liner assembly 104 and the release coating 136. The plurality of longer teeth 220 have a first tine-blade 221 and second tine-blade 223 (see FIG. 9A) configured to create the pair of longitudinal tine-cuts 120 all the way through the release liner assembly 104 of the label stock 101. The remaining plurality of longer teeth 230 are configured to create the weakened separation lines 118 in the release liner assembly 104 and the release coating 136 adjacent to the pair of longitudinal tine-cuts 120 as shown in FIG. 2A. Accordingly, the bi-level die station 200 is configured to create the through-cuts 108 defining the shape or perimeter of the labels 110 formed on each label sheet assembly 100, and to simultaneously create the pair of longitudinal tine-cuts 120 as well as the weakened separation lines 118 adjacent to the longitudinal tine-cuts 120 in the release liner assembly 104, all from the front surface 102*a* of the facestock sheet assembly 102.

After the label stock 101 exits the bi-level die station 200, the label stock 101 enters a single-level die station 202 (see FIG. 9B). In the single-level die station 202, the first and second transverse cuts 122, 124 through the release liner assembly 104 are cut from the rear surface 104*b* of the release liner assembly 104. The single-level die station 202 includes a backing roll or anvil 280 adjacent to the top surface of the label stock 101 and a knife roll cylinder 270 adjacent to the top surface of the label stock 101, such that the label stock 101 is disposed between the knife roll cylinder 270 and the backing roll or anvil 280. The knife roll cylinder 270 has knives or blades 271 that cut through the release liner assembly 104 to define the plurality of first and second transverse cuts 122, 124 in the release liner assembly 104. After the first and second transverse cuts 122, 124 are cut into the label stock 101, the label sheet assemblies 100 exit the single-level die station 202.

With reference now to the flowchart illustrated in FIG. 10, a method 300 of manufacturing a label sheet assembly 100 according to the present invention will be described. The method 300 includes a task 310 of providing a roll of label stock 101 having a facestock sheet assembly 102 releasably adhered to a release liner assembly 104. The label stock 101 can include any suitable number of layers, including the layers described above with reference to FIGS. 3-4. To form the labels 110 in the label sheet assembly 100, the method 300 includes a task 320 of bi-level die cutting through facestock sheet assembly 102 to form through-cuts 108 in the facestock sheet assembly 102 and both parallel through cuts (i.e., tine-cuts 120) and parallel perforations (i.e., weakened separation lines 118 or plurality of cuts 125 and a plurality of ties 123) in the release liner assembly 104. Additional details regarding the task 320 of bi-level die cutting through the label stock 101 is described above with reference to FIGS. 9A-9C. The method 300 also includes a task 330 of die cutting through the release liner assembly 104 to form the plurality of first and second transverse cuts 122, 124 in the release liner assembly 104, as shown in FIG. 2A. The method 300 also includes a task 340 of sheeting the label stock 101 into individual label sheet assemblies 100.

While the method 300 of manufacturing the label sheet assembly 100 can include each of the tasks described above and shown in FIG. 10, one or more of the tasks described above and shown in FIG. 10 can be absent and/or additional tasks can be performed. Furthermore, in the method 300 of manufacturing the label sheet assembly 100 according to one embodiment, the tasks can be performed in the order depicted in FIG. 10. However, the present invention is not limited thereto and, in a method of manufacturing the label sheet assembly 100 according to other embodiments of the present invention, the tasks described above and shown in FIG. 10 can be performed in any other suitable sequence. For example, in one example embodiment, the task 320 of bi-level die cutting through the facestock sheet assembly 102 to form through-cuts 108 in the facestock sheet assembly 102 and both parallel through cuts (i.e., tine-cuts 120) and parallel perforations (i.e., weakened separation lines 118 or plurality of cuts 125 and a plurality of ties 123) in the release liner assembly 104 is performed before the task 330 of die cutting through the release liner assembly 104 to form the first and second transverse cuts 122, 124 in the release liner assembly 104. In an alternate example embodiment, the task 330 of die cutting through the release liner assembly 104 to form first and second transverse cuts 122, 124 in the release liner assembly 104 is performed before task 320.

With reference now to the flowchart illustrated in FIG. 11, a method 400 of manufacturing a label sheet assembly 100 according to another embodiment of the present invention will be described. The method 400 includes a task 410 of providing a roll of label stock 101 having a facestock sheet assembly 102 releasably adhered to a release liner assembly 104. The label stock 101 can include any suitable number of layers, including the layers as described above with reference to FIGS. 3-4. The method 400 includes a task 420 of die cutting through the facestock sheet assembly 102 with a knife roll cylinder 250 having single-level knives. Task 420 includes die cutting through the facestock sheet assembly 102 to form through-cuts 108 in the facestock sheet assembly 102. The method 400 also includes a task 430 of die cutting through the release liner assembly 104 to form both parallel through cuts (i.e., tine-cuts 120) and parallel perforations (i.e., weakened separation lines 118 or plurality of cuts 125 and a plurality of ties 123) in the release liner assembly 104. Task 430 can also include die cutting through the release liner assembly 104 to form first and second transverse cuts 122, 124 in the release liner assembly 104. The method 400 also includes a task 440 of sheeting the label stock 101 into individual label sheet assemblies 100.

While the method 400 of manufacturing the label sheet assembly 100 can include each of the tasks described above and shown in FIG. 11, one or more of the tasks described above and shown in FIG. 11 can be absent and/or additional tasks can be performed. Furthermore, in the method 400 of manufacturing the label sheet assembly 100 according to another embodiment, the tasks can be performed in the order depicted in FIG. 11. However, the present invention is not limited thereto and, in a method of manufacturing the label sheet assembly 100 according to other embodiments of the present invention, the tasks described above and shown in FIG. 11 can be performed in any other suitable sequence. For example, in one embodiment, the task 420 of die cutting through the facestock sheet assembly 102 to form through-cuts 108 in the facestock sheet assembly 102 is performed before the task 430 of die cutting through the release liner assembly 104 to form both parallel through-cuts (i.e., tine-cuts 120) and parallel perforations (i.e., weakened separation lines 118 or plurality of cuts 125 and a plurality of ties 123) in the release liner assembly 104. In an alternate example embodiment, the task 430 of die cutting through the release liner assembly 104 to form both parallel through-cuts (i.e., tine-cuts 120) and parallel perforations (i.e., weakened separation lines 118 or plurality of cuts 125 and a plurality of ties 123) in the release liner assembly 104 is performed before task 420.

Figure 12:
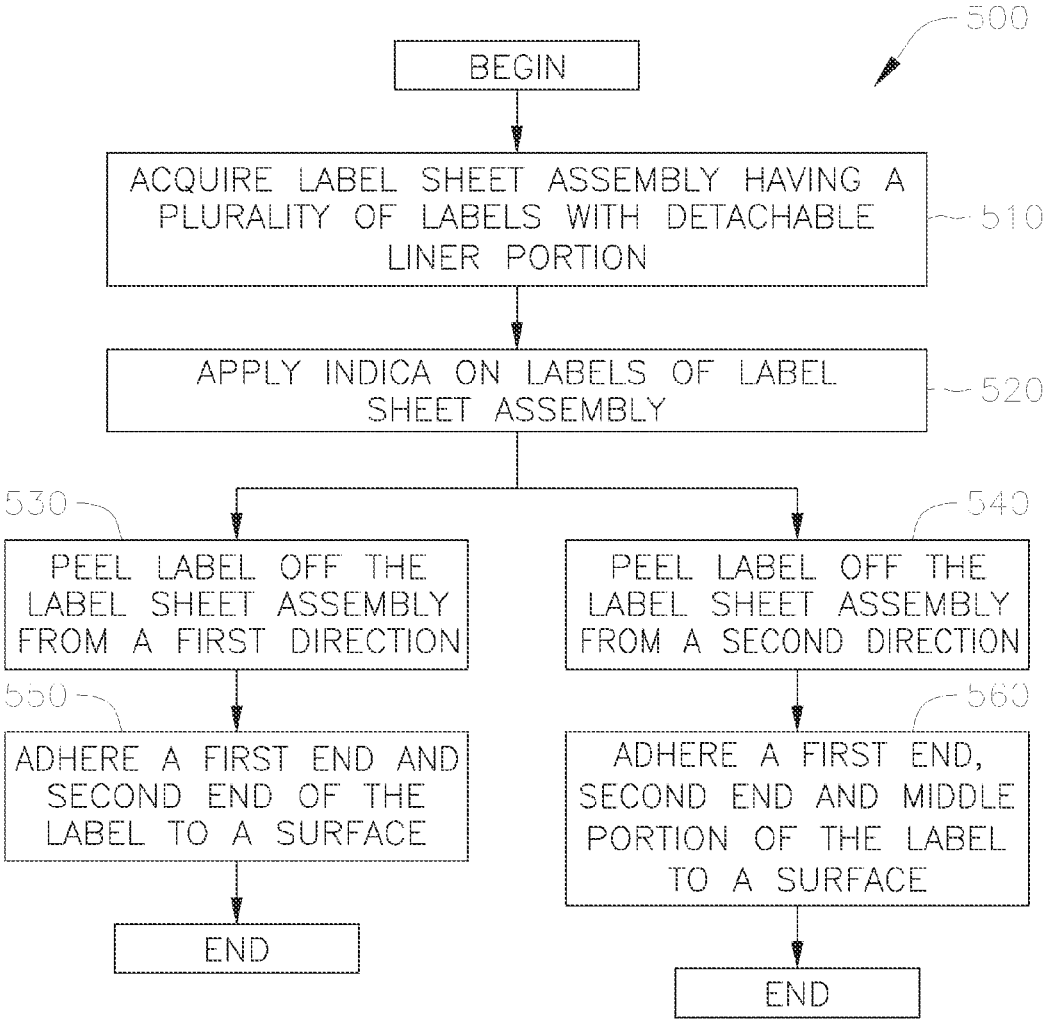
FIG. 12 is a flowchart illustrating a method for using a label sheet assembly and the labels thereon according to the present invention.

With reference now to the flowchart illustrated in FIG. 12, a method 500 of using the label sheet assembly 100 and/or labels 110 thereof according to the present invention will be described. In one embodiment, the method 500 includes a task 510 of acquiring a label sheet assembly 100 having a plurality of labels 110 releasably adhered to a detachable portion 115 of a release liner assembly 104. The method 500 also includes a task 520 of applying indicia 149 on the labels 110 of the label sheet assembly 100. A person of ordinary skill in the art will appreciate that the indicia 149 can be applied using a printer or copier 146, a writing implement, or any other suitable indicia-marking instrument. To use a label 110 from the label sheet assembly 100, a user has two options depending on the particular use required. A first option of the method 500 includes a task 530 of peeling a label 140 off the label sheet assembly 100 in a first direction 140. As described with regards to FIGS. 5A and 5B, a label 141 peeled or removed in a first direction 140 has exposed adhesive 134 at the first and second ends 112, 114 of the label 141. Accordingly, the first option of the method 500 includes a task 550 of adhering the first end 112 and second end 114 of the label 141 to a surface, with the detachable portion 115 of the release liner assembly 104 being releasably adhered to the middle portion 116 of the label 141. In the alternative, a second option of the method 500 includes a task 540 of peeling a label 143 off the label sheet assembly 100 in a second direction 142. As described above with regards to FIGS. 6A and 6B, a label 143 peeled or removed in a second direction 142 has exposed adhesive along the entire length $L_L$ of the label 143, including at the first end 112, the second end 114, and the middle portion 116 of the label. Accordingly, the second option of the method 500 includes a task 560 of adhering the label 143 along its entire length $L_L$ to a surface.

While the method 500 of using the label sheet assembly and/or labels can include each of the tasks described above and shown in FIG. 12, one or more of the tasks described above and shown in FIG. 12 can be absent and/or additional tasks can be performed. Furthermore, in the method 500 of using the label sheet assembly and/or labels according to one embodiment, the tasks can be performed in the order depicted in FIG. 12. However, the present invention is not limited thereto and, in a method of using the label sheet assembly and/or labels of the present invention, the tasks described above and shown in FIG. 12 can be performed in any other suitable sequence.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," "below," "above," "parallel," "perpendicular," "first," "second," "third," "fourth" and similar terms have been used herein to describe a spatial relationship of one element to another, it is understood that these terms are intended to encompass different orientations of the various elements and components of the invention in addition to the orientation depicted in the figures.

What is claimed is:

1. A label sheet assembly comprising:

a release liner assembly including a plurality of detachable portions; and a plurality of labels having a bi-directional peal and being releasably coupled to the release liner assembly, each label overlying at least one of the detachable portions;

wherein:

weakened separation lines, a U-shaped cut, and a transverse cut define each of the detachable portions, the detachable portions are configured to remain coupled to the labels as the labels are peeled from the release liner assembly in a first direction, and the detachable portions are configured to remain part of the release liner assembly and separate from the labels as the labels are peeled from the release liner assembly in a second direction.

2. The label sheet assembly of claim 1, further comprising:

a facestock sheet assembly that includes the labels releasably coupled to the release liner assembly; and cuts in the facestock sheet assembly, the cuts defining the shapes of the labels.

3. The label sheet assembly of claim 1, wherein the weakened separation lines are selected from the group consisting of cuts and ties, perforated cuts, and micro-perforated cuts.

4. The label sheet assembly of claim 1, wherein the weakened separation lines in the release liner assembly underlie a portion of the cuts in the facestock sheet assembly.

5. The label sheet assembly of claim 1, wherein the weakened separation lines in the release liner assembly underlie the labels.

6. The label sheet assembly of claim 1, wherein:

the U-shaped cut includes tine-cuts; and the tine-cuts are co-linear with the weakened separation lines.

7. The label sheet assembly of claim 1, wherein:

the U-shaped cut includes tine-cuts; and the tine-cuts are offset from the weakened separation lines.

8. The label sheet assembly of claim 1, wherein the label sheet includes five labels and five detachable portions.

9. The label sheet assembly of claim 1, wherein:

each label includes a first end, a second end and a middle portion disposed between the first end and the second end wherein the middle portions of the labels overlie the detachable portions.

10. A label sheet assembly comprising:

a release liner assembly including a detachable portion; and a label having a bi-directional peal and being releasably coupled to the release liner assembly, the label having a width and a length wherein the length is greater than the width, the label overlies the detachable portion;

wherein:

weakened separation lines, a U-shaped cut, and a transverse cut define the detachable portion, the detachable portion having a width and a length wherein the length is greater than the width and the width of the detachable portion is less than or equal to the width of the label;

the detachable portion is configured to remain coupled to the label as the label is peeled from the release liner assembly in a first direction, and the detachable portion is configured to remain part of the release liner assembly and separate from the label as the label is peeled from the release liner assembly in a second.

11. The label sheet assembly of claim 10, further comprising:

a facestock sheet assembly that includes the label releasably coupled to the release liner assembly; and cuts in the facestock sheet assembly, the cuts defining the shape of the label.

12. The label sheet assembly of claim 11, wherein the sheet assembly includes a plurality of labels and a plurality of detachable portions.

13. A label sheet assembly comprising:

a release liner assembly including a detachable portion; and a label including an adhesive layer that is releasably coupled to the release liner assembly, the label having a first end, a second end and a middle portion disposed between the first end and the second end wherein the middle portion of the label overlies the detachable portion;

wherein:

weakened separation lines, a U-shaped cut, and a transverse cut define the detachable portion, the detachable portion is configured to remain coupled to the label as the label is peeled from the release liner assembly in a first direction to at least partially expose a portion of the adhesive layer, and the detachable portion is configured to remain part of the release liner assembly and separate from the label as the label is peeled from the release liner assembly in a second direction to expose the adhesive layer at the middle portion.

14. The label sheet assembly of claim 13, further comprising:

a facestock sheet assembly that includes the label releasably coupled to the release liner assembly; and cuts in the facestock sheet assembly, the cuts defining the shape of the label.

15. The label sheet assembly of claim 13, wherein the weakened separation lines are selected from the group consisting of cuts and ties, perforated cuts, and micro-perforated cuts.

16. The label sheet assembly of claim 13, wherein the weakened separation lines in the release liner assembly underlie a portion of the cuts in the facestock sheet assembly.

17. The label sheet assembly of claim 13, wherein the weakened separation lines in the release liner assembly underlie the label.

18. The label sheet assembly of claim 13, wherein:

the U-shaped cut includes tine-cuts; and the tine-cuts are co-linear with the weakened separation lines.

19. The label sheet assembly of claim 13, wherein:

the U-shaped cut includes tine-cuts; and the tine-cuts are offset from the weakened separation lines.

* * * * *